United States Patent [19]

Torisawa et al.

[11] 4,315,329

[45] Feb. 9, 1982

[54] LOAD MEASURING DEVICE FOR THE GEAR TRAIN OF A TIMEPIECE

[75] Inventors: Akira Torisawa; Makoto Ueda; Masaharu Shida, all of Tokyo, Japan

[73] Assignee: Kabushiki Kaisha Daini Seikosha, Tokyo, Japan

[21] Appl. No.: 42,073

[22] Filed: May 24, 1979

[30] Foreign Application Priority Data

Sep. 12, 1978 [JP] Japan ..... 53/112009

[51] Int. Cl.[3] ..... G04B 19/00

[52] U.S. Cl. ..... 368/76; 368/28; 368/35

[58] Field of Search ..... 58/23 R, 23 BA, 23 D; 368/28–30, 35, 76; 73/6

[56] References Cited

U.S. PATENT DOCUMENTS 3,855,781 12/1974 Chihara ..... 58/4 A

*Primary Examiner*—Ulysses Weldon

*Attorney, Agent, or Firm*—Robert E. Burns; Emmanual J. Lobato; Bruce L. Adams

[57] ABSTRACT

A load measuring device for a stepping motor of an analogue electronic timepiece having a stator, a rotor and a coil includes a pulse generator for producing a range of different pulse width normal driving pulses and a driving circuit for successively applying the driving pulses to the motor. A detector detects the rotation and non-rotation state of the rotor in response to the application of each driving pulse and a control circuit is responsive to the detection by the detector for controlling the application by the driving circuit of the minimum pulse width normal driving pulse capable of driving the motor. Each minimum pulse width driving pulse corresponds to the load on the motor at that time and an analyzer analyzes the pulse width of the driving pulses to thereby indicate the load on the motor.

5 Claims, 18 Drawing Figures

FIG. 1 (B) PRIOR ART

LOAD MEASURING DEVICE FOR THE GEAR TRAIN OF A TIMEPIECE

BACKGROUND OF THE INVENTION

This invention relates to load measuring apparatus for the load of the gear train of a timepiece, especially, an analogue quartz-crystal timepiece, and more particularly, this invention aims to measure the load of the gear train by replacing it with a corresponding pulse-width of a driving pulse of a motor.

Conventionally, the load of the gear train was measured from the minute hand-side with a strain gauge because a measurement from the motor-side, which is the transmission course of the torque of a timepiece, is difficult since a timepiece has a speed reduction train wheel. In this case, the sense of the measurement is opposite to the regular transmission course of the torque, and there is a catch of the wheels etc. so, an exact measurement is not realized.

SUMMARY OF THE INVENTION

The object of this invention is to eliminate such a shortage. Referring now to a detailed description, an outline of a load measuring apparatus of the gear train of a timepiece according to this invention will be described.

Generally, in an analogue quartz-crystal timepiece, an oscillation frequency of the quartz oscillator comprises a time standard, and the time standard signal is divided into one second-signal by a dividing circuit, and the signal is supplied to the motor, and the gear train is moved and time is displayed.

BRIEF DESCRIPTION OF THE DRAWINGS

FIG. 1 (B) shows a driving pulse waveform of a conventional step motor;

FIG. 7 (B) shows the rotary direction of the rotor when a driving pulse is applied thereto;

FIG. 7 (C) shows the rotary direction of the rotor when the rotor does not rotate;

FIG. 7 (D) shows the rotary direction of the rotor just after the a driving pulse is applied thereto in the case where the rotor rotates;

DETAILED DESCRIPTION OF THE INVENTION

Figure 1:
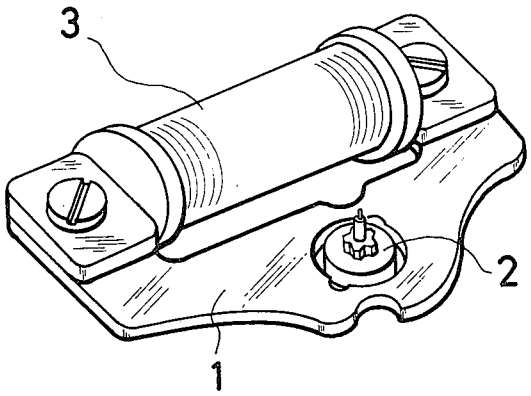
FIG. 1 (A) is a perspective plan view of a step motor for an electronic watch of the present invention.
Figure 1:
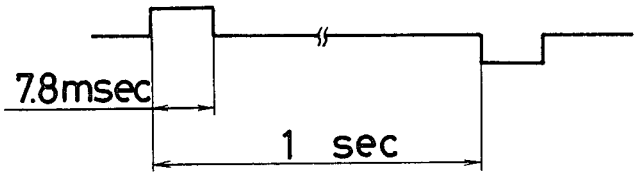
Figure 2:
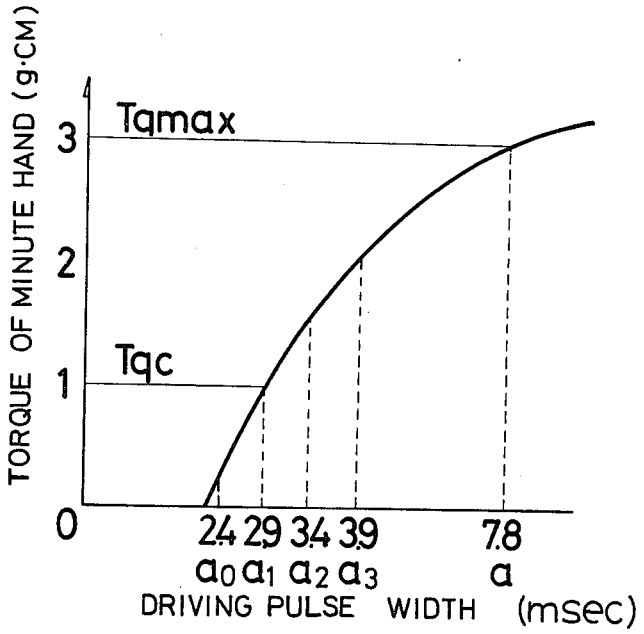
FIG. 2 is a graph showing the relationship between driving pulse-width and the torque of the minute hand, in accordance with this invention.

FIG. 1 (A) shows a motor used frequently in an analogue quartz-crystal timepiece, which consists of a stator 1, a rotor 2 and a coil 3. To this motor, an inverting pulse is supplied once every second, as shown in FIG. 1 (B). FIG. 2 shows the relationship between the pulse-width supplied to the motor and the output torque of the minute hand shaft of the motor. As is evident from the graph, there is an intimate relationship between pulse-width and output torque, and as the pulse-width becomes wider, the output torque increases.

When it is necessary to know gear train torque or the load of the gear train of a calendar mechanism of a quartz timepiece, if a pulse of the minimum width which enables rotation of the motor can be supplied constantly, the width of the supplied pulse shows torque of the gear train or torque of the load of the calendar mechanism. If this is continued for example for 24 hours, a variation of pulse width, that is, a variation of the load of the gear train is clearly found. Therefore, if pulses which rotate a rotor, whose width is the minimum that can be supplied constantly, a measure of the load of the gear train is possible.

Referring now to a pulse-supplying device, as described above, FIG. 1 (A) is a step motor which drives a gear train and at the same time, measures the load of the gear train of a timepiece in this invention and is included inside of the electronic timepiece. As the drive is executed by an inverting pulse in this example, conventionally, the drive is executed by a pulse whose waveform is as shown in FIG. 1 (B) for both the hands and calendar mechanism of an elctronic timepiece. In this case, the width of the conventional driving pulse is set so that the timepiece is enabled to operate in the worst case circumstance.

In such a timepiece, the minimum pulse-width which enables a drive is considerably small, and by continually monitoring, the minimum pulse-width which enables a drive of a step motor, the weight of the load of the gear train, the weight of the calendar load and an allowance for a pulse-width to prevent stopping can be found.

FIG. 2 shows the relationship between driving pulse-width and torque at the minute hand, and the drive is carried out with $a=7.8$ msec normally, and $T_q=3$ gcm is obtained as a torque at the minute hand.

However, this step motor can be normally driven by a pulse-width $a_0=2.4$ msec. Further, this timepiece whose calendar load $T_{qc}=1.0$ gcm can not be rotated by a pulse-width $a_1=2.9$ msec and can be barely rotated by a pulse-width $a_2=3.4$ msec.

Thus, by preparing many pulse-widths, and checking up which pulse drives the step motor, the load of the step motor owing to a resistance of the load of the gear train of a timepiece and the torque which is necessary for the calendar and their condition of variation can be measured.

In this embodiment, one of the pulse widths $a_0=2.4$ msec, $a_1=2.9$ msec, $a_2=3.4$ msec, $a_3=3.9$ msec is used for the drive. However, a measure by a man after the drive takes a lot of time, this detection of rotation and non-rotation of the rotor is judged automatically by the difference of induced voltages made by vibration of the rotor after the impression of a driving pulse, and the minimum driving pulse is detected automatically.

Figure 3:
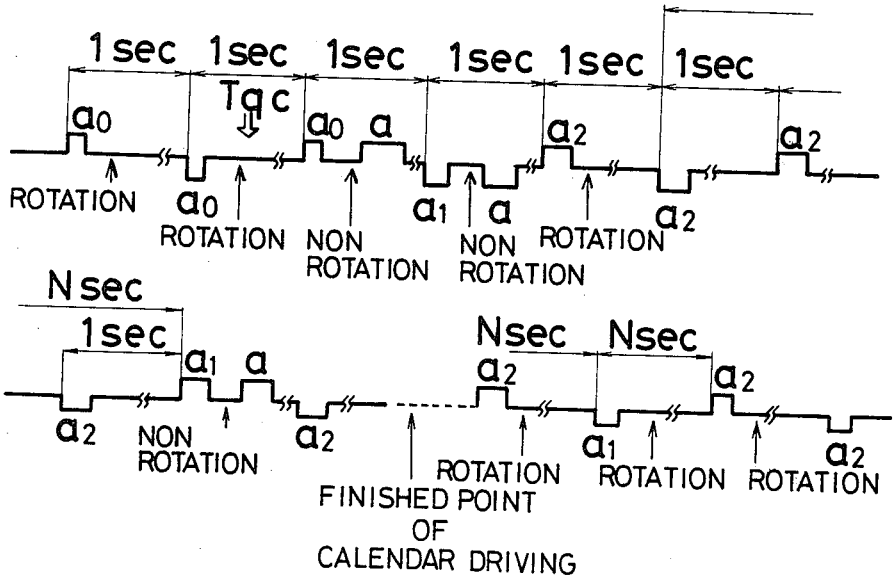
FIG. 3 is a timing chart of the driving system of an electronic timepiece according to this invention.

FIG. 3 shows the change of the pulse width. In this embodiment, the rotor is driven by a driving pulse once every second, rotation and non-rotation is judged and if the rotor is judged "non-rotation", a correction drive with a pulse-width, a=7.8 msec, is executed. But generally, the measure is done by acceleration of more than 1 HZ. This condition according to FIG. 3 is now explained.

Normally, a pulse width $a_0$=2.4 msec is used for the drive. And when the rotor does not rotate with a pulse width $a_0$=2.4 msec because of a calendar load etc, a detecting circuit judges that the rotor does not rotate, and immediately, a correction driving pulse is used for the drive. As the correction driving pulse, a pulse-width of a=7.8 msec is used generally. Then one second after the application of the driving pulse of pulse width $a_0$=2.4 msec, the next larger driving pulse of pulse width $a_1$=2.9 msec is applied to the step motor.

However, according to the embodiment of FIG. 2, calendar torque Tqc is not attained with $a_1$=2.9 msec, the rotor does not rotate again, and the drive is performed with a correction pulse-width a=7.8 msec. Then, a normal driving pulse, one second after, becomes automatically $a_2$=3.4 msec, and the output torque this time is larger than the calendar torque Tqc, so, the step motor is driven with a pulse width $a_2$=3.4 msec, once every second hereinafter.

However, if the pulse-width $a_2$=3.4 msec continues, even after the calendar load disappears, a condition of variation of load is difficult to be determined, so, the driving pulse is shortened every N seconds (for example every two seconds or three seconds) and the pulse-width becomes $a_1$=2.9 msec after the pulse width $a_2$=3.4 msec is output N times successively. Further, when $a_1$=2.9 msec is output N times successively, the pulse-width becomes $a_0$=2.4 msec. In this example, if the rotor is judged "non-rotation", the drive is carried out with a pulse-width a=7.8 msec immediately. But another way is possible by which the drive is carried out with $a_1$=2.9 msec if the rotor does not rotate with $a_0$=2.4 msec, and if the rotor still does not rotate, $a_2$=3.4 msec is used. The common difference of pulse widths is 0.5 msec in this embodiment, however more finely dividing the pulse widths is necessary in the case of measuring of variation of smaller loads. But its principle is the same as in the above noted description. The characteristic of this invention is in a mechanism which judges "rotation" and "non rotation" of the rotor of the step motor of an electronic timepiece without using any special sensor.

Figure 4:
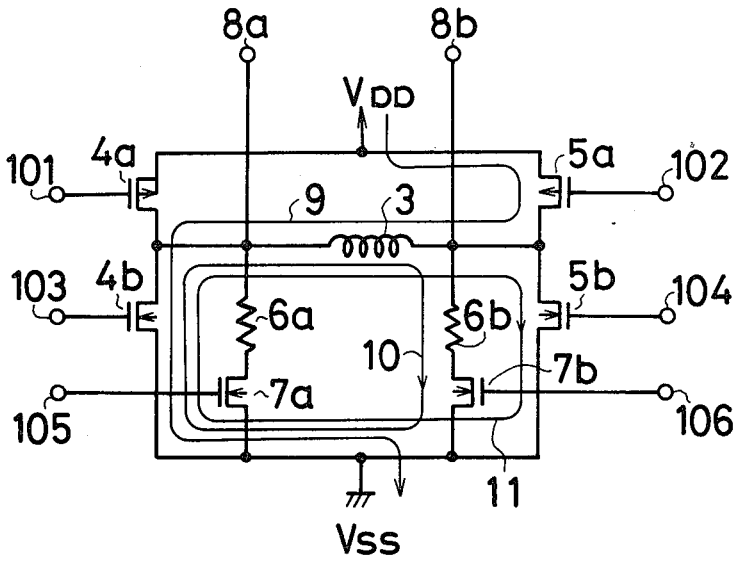
FIG. 4 shows a step-motor driving portion and one part of a detection-portion of a measuring device according to this invention.

FIG. 4 shows the driving circuit of a step motor of a measuring device in which N gates 4*b*, 5*b*, and P gates 4*a*, 5*a* are constituted so that they may go into the off condition at the same time to detect "rotation" and "non-rotation" of the rotor, and it provides detecting resistors 6*a*, 6*b* and N gates 7*a*, 7*b* for switching these resistors.

Figure 5:
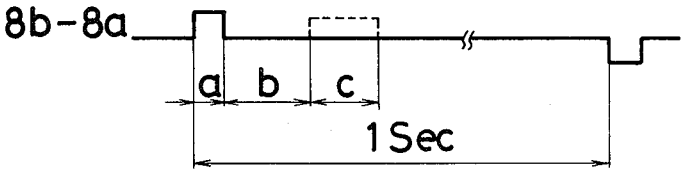
FIG. 5 is a timing chart of the detection of rotation and non-rotation of the rotor.

FIG. 5 is a time chart of the rotation-detecting system. In the section "a" in FIG. 5, current flows in a loop 9 shown in FIG. 4. And when the loop is changed to a loop 10 which includes the detecting resistor 6*b* in the section "b" of FIG. 5, a voltage generated by an oscillation of rotor 2 is developed at a terminal 8*b*. If a signal of "non-rotation" is detected in the detecting section "b", a current flows again in coil 3 of the loop 9 of FIG. 4 in a section of c of FIG. 5, and a correction drive of the step motor is performed with a pulse which is sufficiently wide.

A detailed description of the principle of the detection of "rotation" and "non-rotation" of the rotor will now be given.

Figure 6:
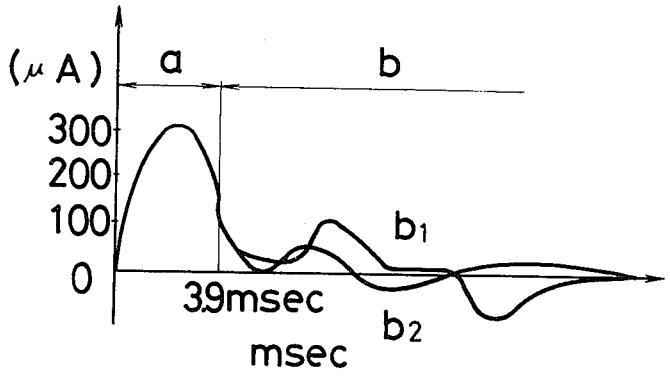
FIG. 6 shows current waveforms when the rotor rotates and when it does not rotate.
Figure 7A:
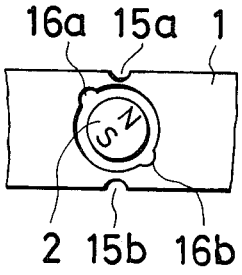
FIG. 7 (A) shows the relationship between the positions of the rotor and the stator when the rotor rests.
Figure 7B:
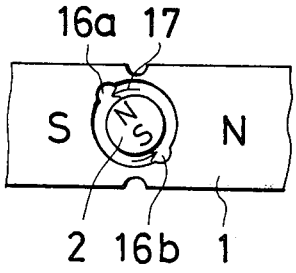
Figure 7C:
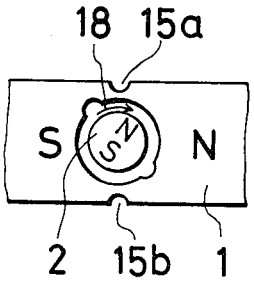
Figure 7D:
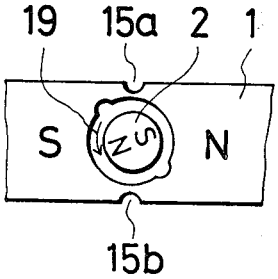

FIG. 6 shows a waveform of current flowing in the coil 3 of a step motor having 10,000 turns and whose coil resistance is 3 kΩ, and driving pulse-width "a" is 3.9 msec, presenting almost the same waveform in spite of rotation or non-rotation.

In the section "b" of FIG. 6, an induced voltage made by an oscillation of the rotor 2 after having a driving pulse supplied thereto is shown, this induced voltage varies according to rotation and non-rotation, or "non load" and "load" of the rotor 2. A waveform of "$b_1$" of FIG. 6 is a waveform when the rotor 2 rotates and "$b_2$" thereof is a waveform when the rotor does not rotate. The driving detection circuit of FIG. 4 was devised to take out the difference of currents according to rotation and non-rotation as the voltage forms, and the circuit is changed to the loop 10 in the section "b" of FIG. 6. As a result, a current generated by an oscillation of the rotor 2 flows in resistor 6*b*, for detection and a voltage waveform which is rather large appears at the terminal 8*b*.

Further, in the loop 10, a current flows in the opposite direction of the loop 9 and a negative portion of waveform of the FIG. 6 appears at the terminal 8*b* as a positive voltage.

Further, in N gate 5*b*, there is a P-N junction between a drain and P-well and it operates as a diode whose anode is connected to "Vss". Therefore, a voltage between 8*b* and Vss is negative and current flows via N gate 5*b* operating as a diode. So, the rotor is braked in the section where the terminal 8*b* is negative. This condition is described below according to FIGS. 7A–D.

FIGS. 7A–D show a relationship between the stator 1 and the rotor 2. FIG. 7 (A) shows the rest state. The stator 1 has interior notches 16*a* and 16*b* for determining index torque and exterior notches 15*a* and 15*b* to enable making of the stator as one-piece.

However, in the case of the two piece type stator, the stator is separated at the portions 15*a* and 15*b*.

The rotor 2 rests with its magnetic poles N, S, at the position of 90° from interior notches 16*a* and 16*b*.

Figure 8:
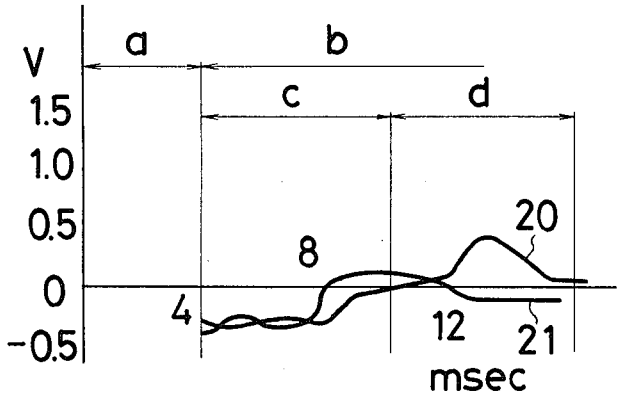
FIG. 8 shows voltages induced by vibration of the rotor in the case where the rotor rotates and in the case where the rotor does not rotate.

FIG. 7 (B) shows the case where a driving pulse is applied thereto and the rotor rotates in a direction of arrow mark 17. Since the driving width is short, for example, 3.9 msec, when the rotor rotates until the poles are near the interior notches, the pulse disappears when the load is small, and the rotor can rotate sufficiently because of the inertia of the rotor, but when the load is big, it does not rotate sufficiently and rotates inversely as shown by arrow 18 in FIG. 7 (C). At this time, as the magnetic poles of the rotor 2 pass near the exterior notches 15*a*, 15*b*, a large current is generated in the coil. However, as the loop 10 of FIG. 4 is used then, a negative voltage is generated at the terminal 8*b* as described above, and a current of forward direction of the diode in N gate 5*b* is effected and the rotor 2 is braked. Therefore, the rotor 2 reduces its speed rapidly and thereafter, a voltage generated by vibration of the rotor 2 is small. On the other hand, in the case where the load is small and the rotor 2 rotates, the rotor 2 rotates in the direction shown by an arrow 19 in FIG. 7 (D), and as magnetic flux generated by the rotor 2 makes an angle of 90° with exterior notches 15*a*, 15*b*, an induced current is small at first, and when the magnetic poles rotate until they are near exterior notches 15*a*, 15*b*, a large current is generated, and as in a circuit of the loop 10 also, a negative voltage is generated at the terminal 8*b*, and the rotor is braked by the diode-effect of N gate 5*b*. Since the amplitude at this time is sufficiently wider than that of the rest position of the rotor shown in FIG. 7 (A), a voltage which is sufficient for a detection of rotation of the rotor 2 is generated at the terminal 8*b* of FIG. 4. A voltage waveform 20 of FIG. 8 is the waveform at the terminal 8*b* when said rotor 2 rotates. A section "a" is the time during which a driving pulse is applied; 3.9 msec. The circuit at that time is loop 9 of FIG. 4 and $V_{DD}=1.57$ V.

In the section "b" of FIG. 8, voltages induced by an oscillation of the rotor are represented. The waveform 20 is the voltage waveform in the case of loop 10 of FIG. 4, wherein a negative voltage is clipped by the diode-effect of N gate 5*b* and the peak of the positive voltage is 0.4 V. On the other hand, waveform 21 is in the case where the rotor does not rotate, wherein the peak of positive voltage is less than 0.1 V, and thus rotation and non-rotation of the rotor can be judged by distinguishing these two voltages. However, section "c" which is immediately after a driving pulse is applied is set as a section of prohibition of detection, since a positive voltage can be generated according to the state of the load, independent of rotation or non-rotation.

In this embodiment, when the pulse width is changed, the prohibition section is also changed, and is set at the value: $a+c=10$ msec.

Further, by limiting the detecting section of rotation and non-rotation to the first peak voltage generating portion by an oscillation of the rotor as described in section "d" of FIG. 8, the detecting operation becomes more reliable.

Figure 9:
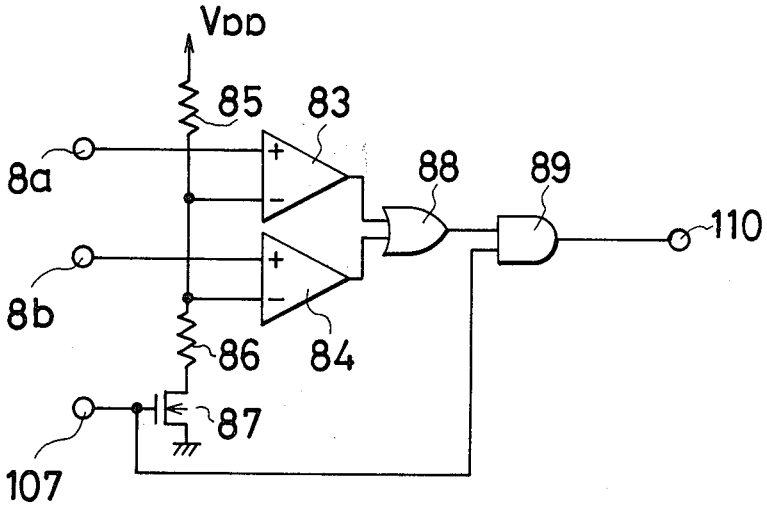
FIG. 9 shows a part of the circuit which detects rotation and non-rotation of the rotor.

FIG. 9 shows a voltage detecting circuit which constitutes one part of the detecting circuit of the driving-detecting circuit in which terminal 8*a*, 8*b* are connected to terminals 8*a*, 8*b* of FIG. 4 and which detects the voltage-difference of signals made by rotation and non-rotation in the section "d" shown in FIG. 8.

Resistors 85, 86 divide a source voltage $V_{DD}$ and the divided voltage becomes a standard signal for detection of rotation and non-rotation of the rotor, and N gate 87 prevents current from flowing in the resistors 85, 86 except during detection. Numerals 83 and 84 are binary comparative logic cells which are called comparators, and when a positive input-voltage is higher than a negative input-voltage, the output goes to the "H" level. The outputs of comparators 83 and 84 are applied to OR circuit 88 and its output is fed to AND circuit 89 with a signal of a terminal 107, and a detection-output is output at a terminal 110.

A construction of an embodiment of a measuring device of a load of the gear train of according to this invention is now referred to.

Figure 10:
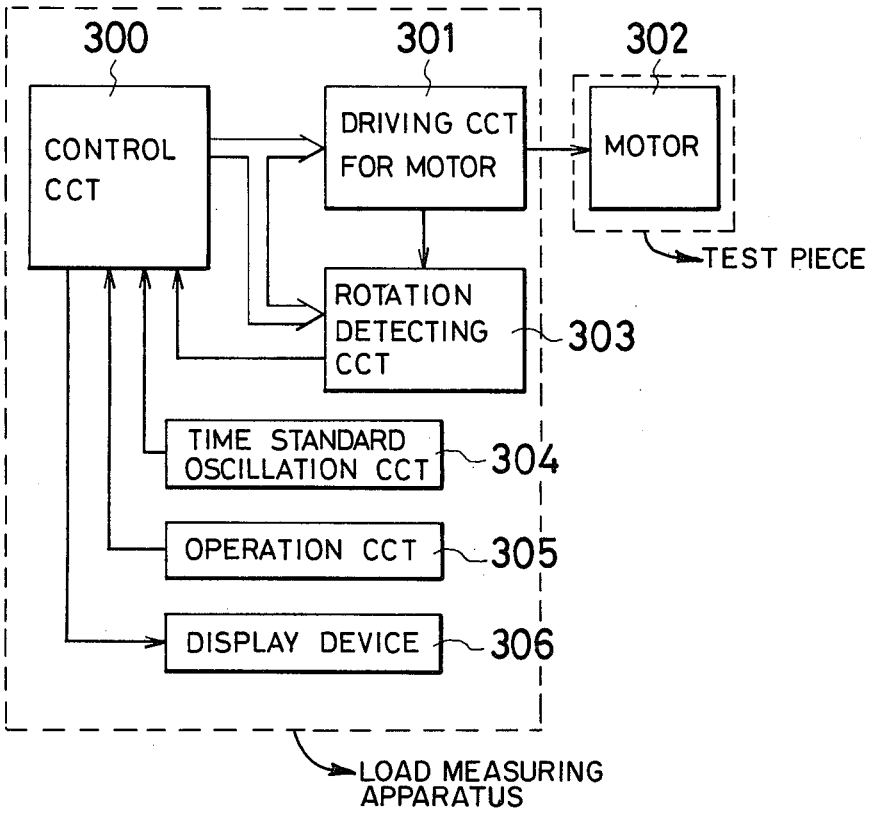
FIG. 10 is a block diagram of an embodiment according to this invention.

FIG. 10 shows a rough construction of this embodiment, wherein numeral 300 is a circuit which makes signals necessary for the operations of circuits which will be described hereinafter, and does complicated operations in response to manipulations of users, which are realized by a microcomputer of a stored-program system. A motor driving circuit 301 and a rotation detecting circuit 303 drive a motor 302 as described above and execute a detection of its rotation. A pulse-width and a timing are given by the control circuit 300 and a rotation detecting signal is input to the control circuit 300. A time standard oscillator 304 produces an oscillation signal which becomes a standard for the width of a driving pulse of the motor and is input to the control circuit 300. An operation circuit 305 consists of an input device for setting the frequency of the driving pulse and pulse-width, etc. A display device 306 displays pulse widths of each moment and receives the driving pulse-width as an analogue signal by using a D-A converter and makes a description of it by a pen recorder.

Referring briefly now to the specification of this embodiment:

1. The common difference of driving pulse widths is 0.124 msec (=1/8192)
2. A setting of the maximum value ($P_1$ MAX) and the minimum value ($P_1$ MIN) in a driving pulse-width which changes automatically is possible
3. When the motor is driven an arbitrary number of times: W (times), the drive is stopped
4. The number of all the normal drives and the number of all correction drives are counted, memorized and displayed
5. The number of normal drives and the number of correction drives at each driving pulse-width are counted, memorized and displayed
6. The pulse-width at each moment is displayed in digital form, and can be described by a pen-recorder via a D-A converter.

Figure 11:
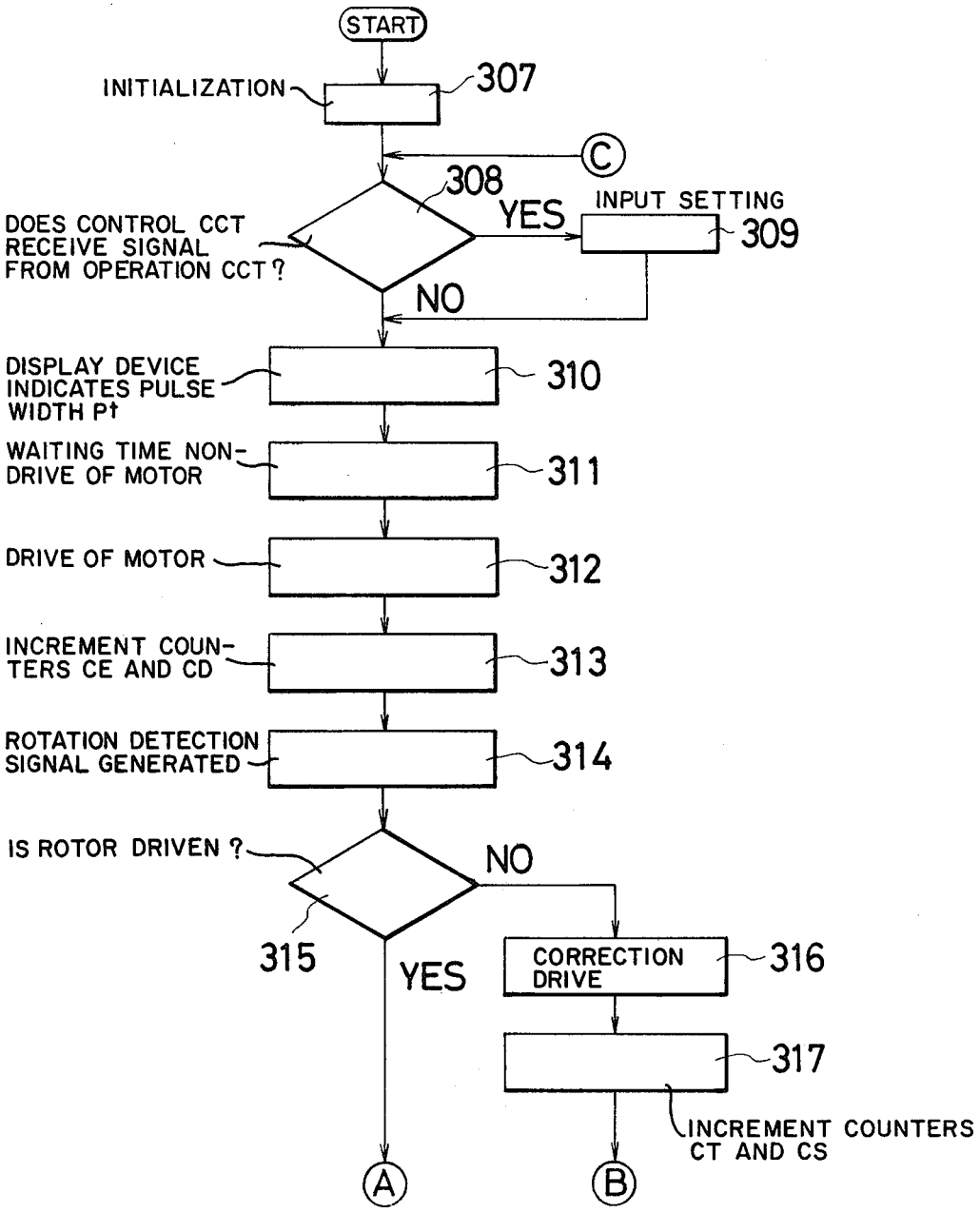
FIGS. 11 (*a*), (*b*) are flow charts of a driving pulse-width and a counter portion respectively according to this invention.
Figure 11B:
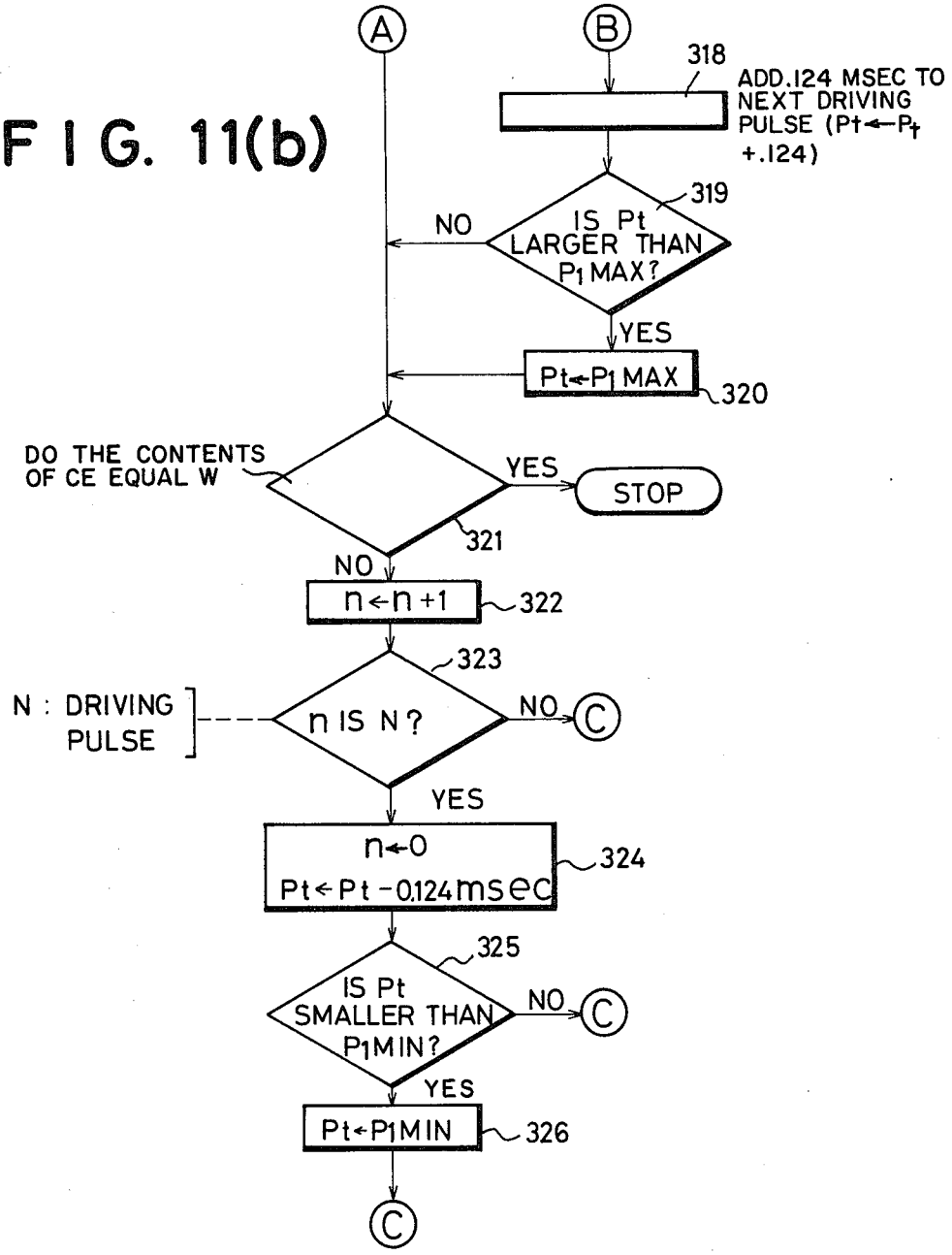

FIGS. 11 (*a*) and (*b*) are a flow chart showing the order of controls and processes of the control circuit 300. In an initialization 307, initialization of various counters and initialization of the timing constant of the driving pulse, etc. are executed.

In a judging box 308 and in a process step 309, the conduct in the case where a user practices some operations is executed, of which a detailed description is omitted since it essentially does not bear relation to this invention. A process step 310 practices a display operation of the display 306. A process step 311 is a time-waiting operation to enable the motor to be driven with the predetermined driving cycle and the motor stops in the meantime. A process step 312 generates a driving pulse and $p^t$ means a driving pulse-width at that time.

In a process step 313, "1", is added to the contents of all drive counter CE for counting all of the driving pulses and the contents of the drive-counter CD ($p^t$) for counting the driving pulses to pulse width $p^t$ in response to the present driving pulse-width $p^t$. CD ($p^t$) is one counter corresponding to present pulse-width $p^t$ among the group of counters CD for calculation of the drive number at each pulse-width provided with a common differences of 0.124 msec, and a counter CS ($p^t$) for counting the number of correction drives is similar.

Process step 314 generates a signal for detection of the rotation of the rotor based on said principle of the detection, and puts in the resulting-detecting signal and splits the process at decision step 315.

In the case where the rotor does not rotate, a correction drive is carried out in the process step 316 and "1" is added to the contents of the all correction drive for counting all of the correction driving pulses counter CT and to the contents of the correction counter CS ($p^t$) which corresponds to a present driving pulse-width pt in a process step 317 and a driving pulse-width of next step is enlarged. 0.124 msec in a process step 318.

In a judgement step 319 and a process step 320, a driving pulse-width is prevented from becoming more than the predetermined maximum driving pulse-width $p_1$ MAX.

In process step 321, the contents of all drive counter CE and preset counter W are compared and when they are in accordance, a pulse output is stopped, which is the operation of the control circuit 300.

After the stop of a pulse output the, contents in the driving counter is read, and a result of the measure of load of gear train is measured by executing other programs.

In a process step 322, a judgment step 323 and a process step 324, "1" is added to the contents of counter "n" each time that the motor is driven once, and when the driving number becomes in accordance with the predetermined shortened cycle N of driving pulses a driving pulse-width of the next step is shortened 0.124 msec. By the series of these processes, a driving pulse-width is shortened 0.124 msec every N times of drives.

In a judgment step 325 and a process step 326, a driving pulse-width $p^f$ is prevented from becoming less than the predetermined minimum pulse-width $P_1$ MIN.

Figure 12:
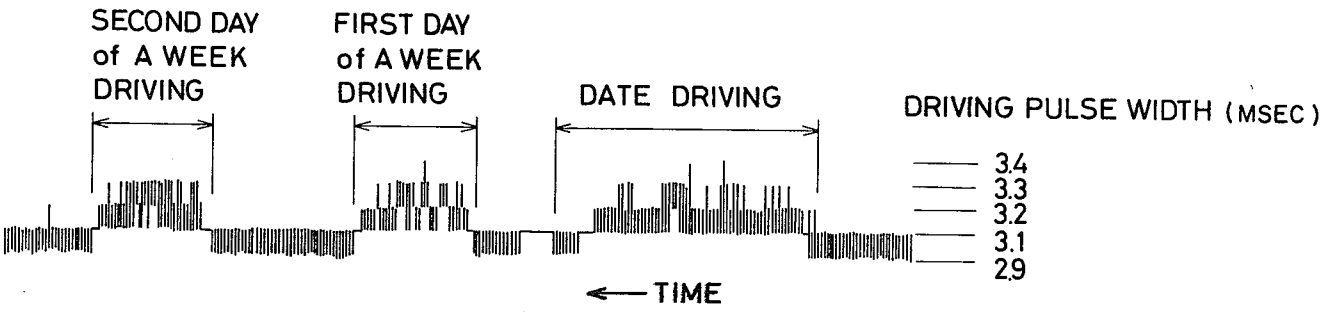
FIG. 12 and FIG. 13 are examples of results of measurements according to invention.
Figure 13:
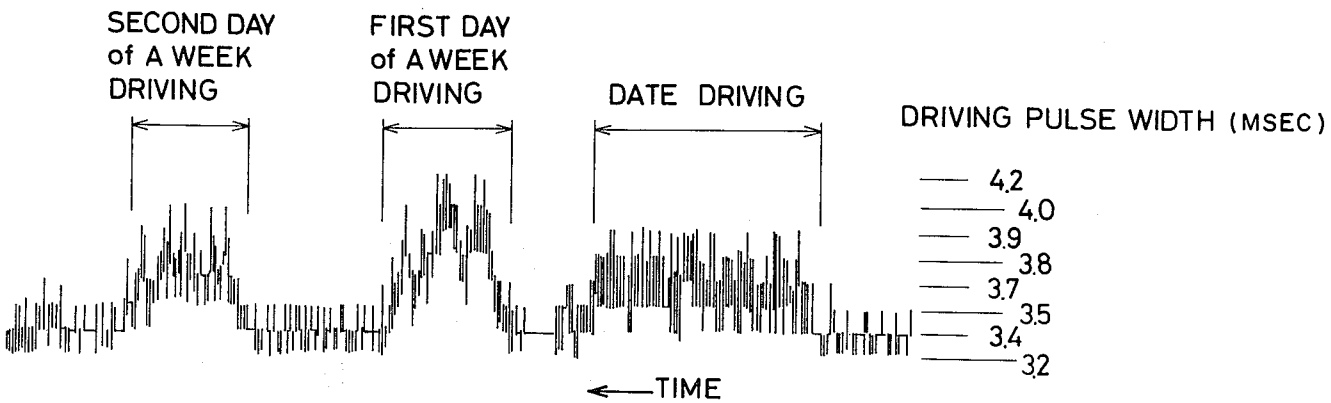

FIG. 12 and FIG. 13 show the results of the measurements of the load of gear train of two analogue crystal-quartz watches at the time of calendar-driving by using the analyzer of this invention. These two watches have the same caliber but their movements are different. The load of the gear train of the watch of FIG. 12 is stable while that of the watch of FIG. 13 fluctuates. So, any problem in calendar drive, and gear train loading is known.

As described above, a measuring device for the load of a gear train according to this invention enables one to measure the load of a gear train and the state of load of an analogue watch by pulse-widths supplied to the motor. Therefore, a special transducer is not necessary and measurement is achieved only by internal circuits. Therefore, a measuring device of low-cost and long-life is realized and its industrial contribution is great.

Also, it goes without saying that this load analyzer for a gear train can be applied to a power transmission mechanism whose driving source is a step motor, as well as crystal-quartz watches.

We claim:

1. A load measuring apparatus for measuring a varying load of a stepping motor of an analogue electronic timepiece having a stator, a rotor and a coil, comprising: means for producing a range of normal driving pulses having discretely different pulse widths each corresponding to a different magnitude of load on the stepping motor; pulse applying means for successively applying the normal driving pulses to the stepping motor coil; detecting means for detecting whether the stepping motor rotor has rotated or not in response to the application of each normal driving pulse; controlling means responsive to the detection by the detecting means for controlling the pulse applying means to effect the application of the normal driving pulses having the minimum pulse width capable of driving the stepping motor rotor in accordance with the load on the motor, the controlling means comprising means for producing correction driving pulses, and means for controlling the pulse applying means to apply to the stepping motor coil a correction driving pulse immediately after a normal driving pulse in response to the detection of nonrotation by the detecting means; and analyzing means for analyzing the pulse widths of the normal driving pulses applied to the stepping motor coil and providing information representative of the varying load on the motor.

2. A load measuring apparatus for measuring a varying load of a stepping motor of an analogue electronic timepiece having a stator, a rotor and a coil, comprising: means for producing a range of normal driving pulses having discretely different pulse widths each corresponding to a different magnitude of load on the stepping motor; pulse applying means for successively applying the normal driving pulses to the stepping motor coil; detecting means for detecting whether the stepping motor rotor has rotated or not in response to the application of each normal driving pulse; controlling means responsive to the detection by the detecting means for controlling the pulse applying means to effect the application of the normal driving pulses having the minimum pulse width capable of driving the stepping motor rotor in accordance with the load on the motor, the controlling means comprising a counter for counting successive normal driving pulses of the same pulse width in the absence of detection of non-rotation, and means responsive to a preselected count in the counter for effecting the application of the normal driving pulse having the next smaller pulse width than said same pulse width by the pulse applying means; and analyzing means for analyzing the pulse widths of the normal driving pulses applied to the stepping motor coil and providing information representative of the varying load on the motor.

3. A load measuring apparatus for measuring a varying load of a stepping motor of an analogue electronic timepiece having a stator, a rotor and a coil, comprising: means for producing a range of normal driving pulses having discretely different pulse widths each corresponding to a different magnitude of load on the stepping motor; pulse applying means for successively applying the normal driving pulses to the stepping motor coil; detecting means for detecting whether the stepping motor rotor has rotated or not in response to the application of each normal driving pulse; controlling means responsive to the detection by the detecting means for controlling the pulse applying means to effect the application of the normal driving pulses having the minimum pulse width capable of driving the stepping motor rotor in accordance with the load on the motor; and analyzing means for analyzing the pulse widths of the normal driving pulses applied to the stepping motor coil and providing information representative of the varying load on the motor, the analyzing means comprising means for converting the pulse widths of the normal driving pulses into analogue values, means for indicating the analogue values and thereby the varying load on the motor, and first counting means for counting the total number of normal driving pulses applied to the stepping motor coil and for terminating the application of the normal driving pulses after counting a given number of normal driving pulses.

4. The apparatus according to claim 3; wherein the analyzing means further comprises second counting means for counting the number of the normal driving pulses of each different pulse width applied to the stepping motor coil.

5. The apparatus according to claim 4; wherein the controlling means comprises means for producing correction driving pulses, and means for controlling the pulse applying means to apply to the stepping motor coil a correction driving pulse immediately after a normal driving pulse in response to the detection of nonrotation by the detecting means; and wherein the analyzing means further comprises third counting means for counting the number of the correction driving pulses applied to the stepping motor coil.

* * * * *